US005458252A

United States Patent [19]

Logel

[11] Patent Number: 5,458,252

[45] Date of Patent: Oct. 17, 1995

[54] INVERTIBLE, PRESSURE-RESPONSIVE SEALING CAP

[75] Inventor: Paul E. Logel, Thornton, Colo.

[73] Assignee: American Precision Plastics Corporation, Northglenn, Colo.

[21] Appl. No.: 253,541

[22] Filed: Jun. 3, 1994

[51] Int. Cl.[6] ..... B65D 39/04; B65D 39/12; B65D 41/04

[52] U.S. Cl. ..... 215/271; 215/331; 220/240

[58] Field of Search ..... 215/270, 271, 215/330, 331; 220/240, 281, DIG. 16, DIG. 17

[56] References Cited

U.S. PATENT DOCUMENTS

| | | | |
|---|---|---|---|
| 2,971,671 | 2/1961 | Shakman | 220/609 X |
| 3,409,167 | 11/1968 | Blanchard | 220/609 |
| 3,441,161 | 4/1969 | Baarn | 215/40 |
| 3,525,455 | 8/1970 | Saunders | 220/624 X |
| 3,788,510 | 1/1974 | Collins | 215/40 |
| 3,973,690 | 8/1976 | Schneider | 215/329 |
| 4,027,776 | 6/1977 | Douglas | 220/281 |
| 4,206,852 | 6/1980 | Dunn et al. | 215/252 |
| 4,489,845 | 12/1984 | Aichinger et al. | 215/329 |
| 4,574,966 | 3/1986 | Sandhaus | 215/270 |
| 4,616,761 | 10/1986 | Nolan | 215/271 |
| 4,678,082 | 7/1987 | Fillmore | 215/271 X |
| 4,714,167 | 12/1987 | Sandhaus | 215/270 |
| 4,771,905 | 9/1988 | Perne et al. | 215/270 |
| 4,852,753 | 8/1989 | Ochs | 215/271 |
| 5,186,344 | 2/1993 | Cook | 215/330 |
| 5,251,770 | 10/1993 | Bartley et al. | 215/271 X |

FOREIGN PATENT DOCUMENTS

| | | |
|---|---|---|
| 119788 | 9/1984 | European Pat. Off. . |
| 2204979 | 8/1973 | Germany . |

*Primary Examiner*—Allan N. Shoap
*Assistant Examiner*—Nathan J. Newhouse
*Attorney, Agent, or Firm*—W. Scott Carson

[57] ABSTRACT

A sealing cap and container combination primarily intended for use in medical applications. The sealing cap of the preferred embodiment includes a central dome-shaped portion, annular portion, and sealing portion. In use, these portions are initially received in the mouth of the container and assume an initial concave shape with the sealing portion of the cap abutting and sealing against the inner surface of the container mouth. Thereafter, as the pressure within the container increases, the concave dome first moves toward a flattened shape and then inverts to a convex shape. As the pressure further increases, the annular portion of the cap then moves to a flattened position substantially perpendicular to the axis of the cap. During all this controlled movement, the sealing force of the cap progressively increases from an initial force to a maximum sealing force. An audible signal arrangement is also included in the design to clearly signal the user when the cap is sufficiently tightened on the container to effect an initial seal.

44 Claims, 7 Drawing Sheets

INVERTIBLE, PRESSURE-RESPONSIVE SEALING CAP

BACKGROUND OF THE INVENTION

1. Field of the Invention

This invention relates to the field of invertible, pressure-responsive sealing caps for containers and more particularly to the field of such sealing caps for medical use wherein the sealing force progressively increases as the pressure within the container increases.

2. Discussion of the Background

Sealing cap and container combinations suitable for medical use present significant design challenges. In virtually all cases, it is required that the seal be reliable and predictable. Additionally, the cap and container combination must not only seal from the outset but also be capable of maintaining an effective seal even as the pressure differential across the cap increases. That is, in many applications and particularly in medical applications, the specimen in the container is often one (e.g., biohazardess materials such urine or tissue samples) that will ferment over time increasing the pressure within the container. Conversely, in many applications including medical ones, the sealed container may be subjected to reduced outside or ambient pressure (e.g., during transport by air freight) which has the same effect of increasing the relative pressure within the container. Additionally, large pressure differentials across the cap can occur even during transport or handling of the sealed container within the same facility (e.g., from a hospital examining room or nursing station via a pneumatic tube system to the hospital lab).

In these and other applications, it is important that the cap form an effective, initial seal and thereafter be capable of maintaining an effective seal as the pressure within the container increases relative to the outside or ambient pressure. With this in mind, the invertible, pressure-responsive sealing cap of the present invention was developed.

SUMMARY OF THE INVENTION

This invention involves a sealing cap and container combination primarily intended for use in medical applications. The sealing cap of the preferred embodiment includes a central dome-shaped portion, annular portion, and sealing portion. In use, these portions are initially received in the mouth of the container and assume an initial concave shape with the sealing portion of the cap abutting and sealing against the inner surface of the container mouth. Thereafter, as the pressure within the container increases, the concave dome first moves toward a flattened shape and then inverts to a convex shape. As the pressure further increases, the annular portion of the cap then moves to a flattened position substantially perpendicular to the axis of the cap. During all this controlled movement, the sealing force of the cap progressively increases from an initial force to a maximum sealing force. As a safety feature and after the annular portion has been essentially flattened by the pressure build up in the container, any subsequent pressure increase will serve to draw the sealing portion of the cap away from sealing engagement with the container mouth. In doing so, this allows leakage to occur in a controlled manner to reduce the pressure and to avoid having the cap and container arrangement fracture and possibly explode.

With the present invention, an effective, initial seal is formed. Additionally, the unique design of the sealing cap of the present invention serves thereafter to progressively increase the sealing force of the cap as the pressure within the container progressively increases relative to the ambient air pressure. An audible signal arrangement is also included in the design to clearly signal the user when the cap is sufficiently tightened or engaged on the container to effect an initial seal.

BRIEF DESCRIPTION OF THE DRAWINGS

FIG. 10 corresponds to the position shown in FIG. 4.

DETAILED DESCRIPTION OF THE PREFERRED EMBODIMENTS

Figure 1:
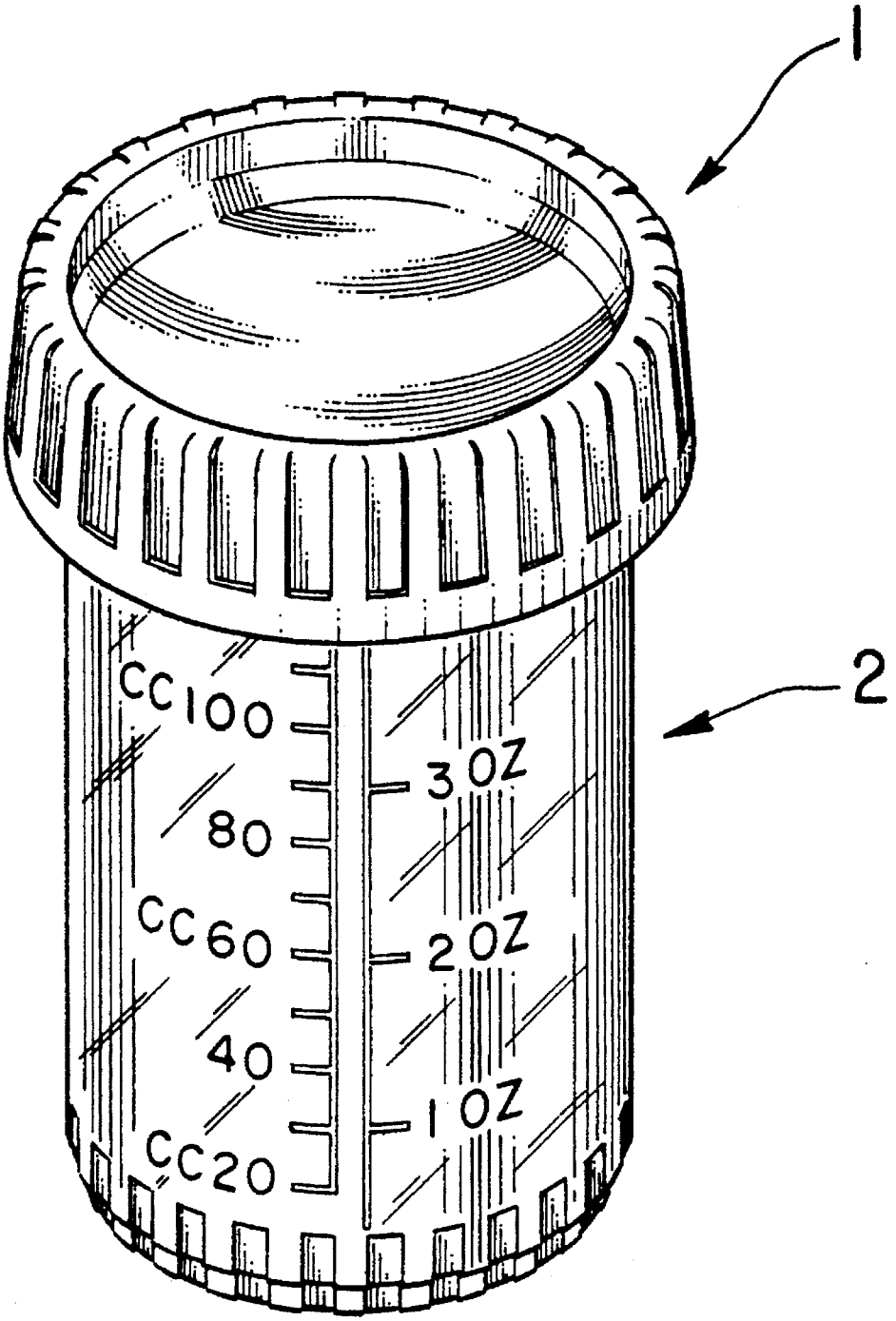
FIG. 1 is a perspective view of the sealing cap and container combination of the present invention.
Figure 2:
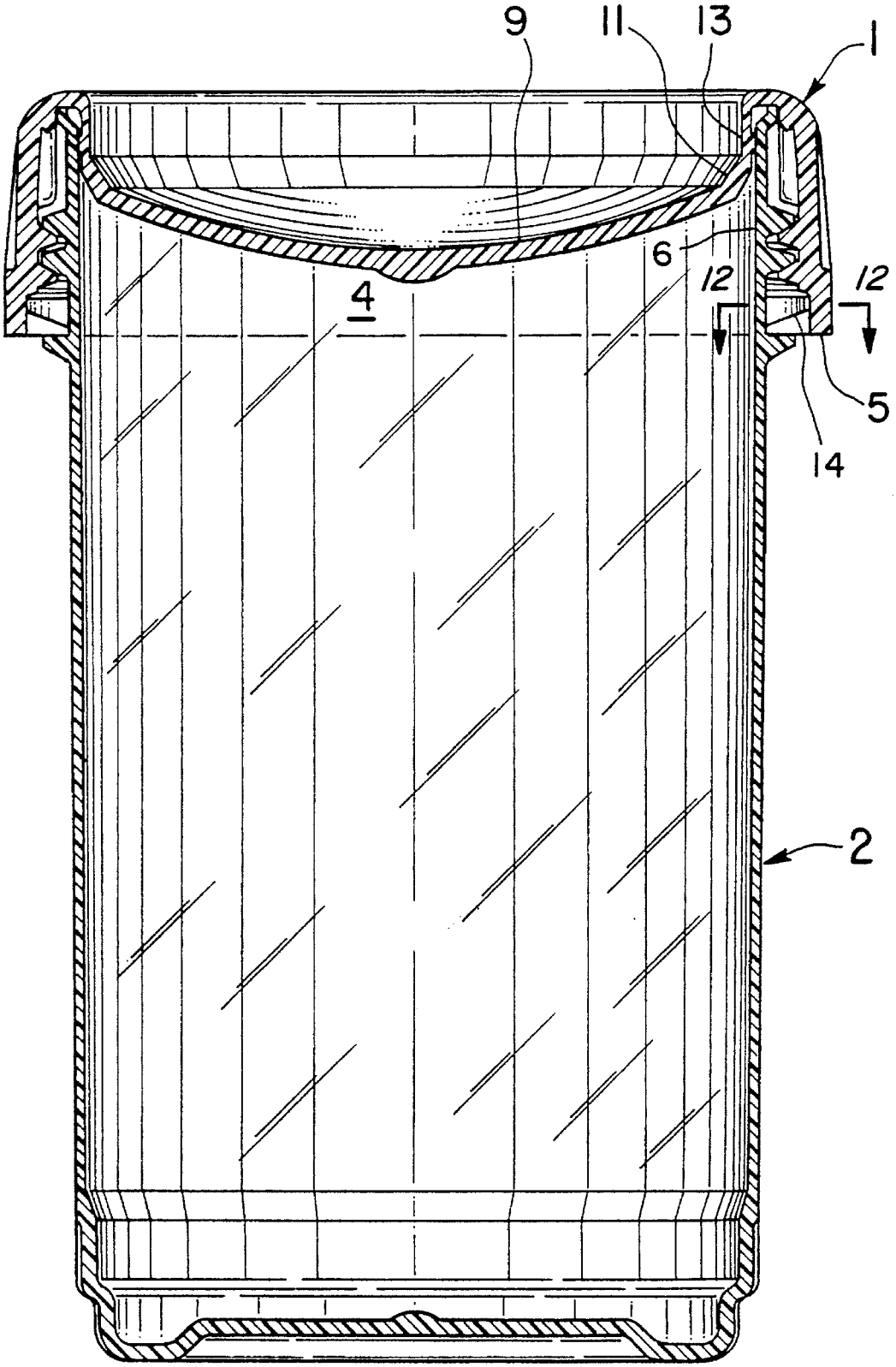
FIG. 2 is a cross-sectional view of the sealing cap and container of FIG. 1.
Figure 3:
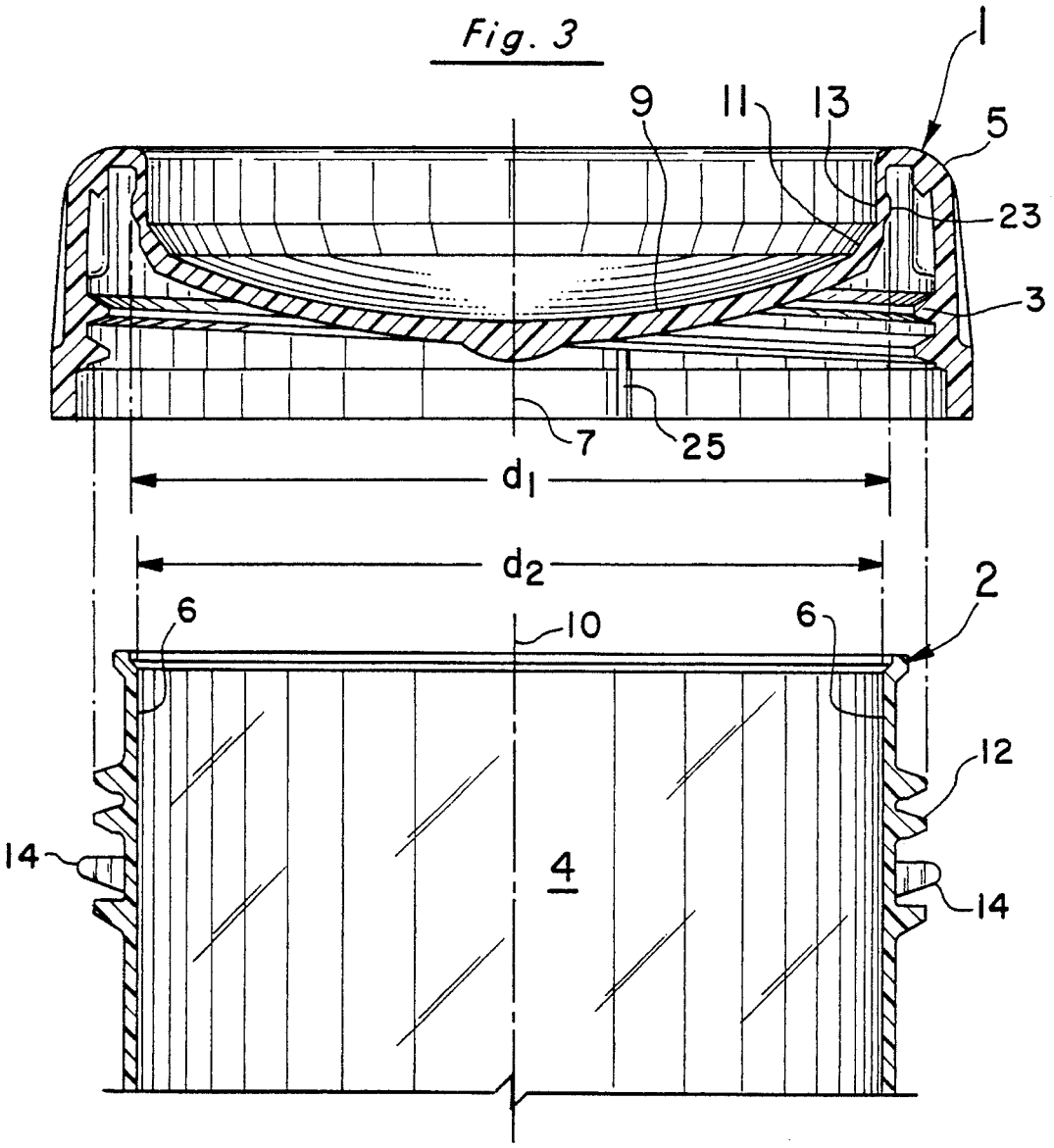
FIG. 3 is an enlarged cross-sectional view of the cap and upper portion of the container.

The cap 1 and container 2 combination of the present invention is shown in its initial, sealing position in FIGS. 1 and 2. The container 2 itself can be of any number of designs and shapes but in the preferred embodiment as illustrated in FIGS. 1–3, the container 2 is a cylindrical container with an open mouth 4 (see FIG. 3). The open mouth 4 as shown has a smooth, cylindrical bore or inner sealing surface 6. The sealing surface 6 extends about and along the container axis 10 and as illustrated faces inwardly toward the container axis 10. The container mouth 4 also has an outwardly facing, threaded portion 12. The cap 1 in turn as shown in FIG. 3 has a mating threaded portion 3 on the cap skirt 5 with the threaded portion 3 facing inwardly toward the cap axis 7. The cap 1 also includes a central, dome-shaped portion 9, annular portion 11, and sealing portion 13. The central, dome-shaped portion 9 as illustrated in FIG. 3 extends outwardly from and about the cap axis 7 and the annular portion 11 extends outwardly from and about the central, dome-shaped portion 9. The sealing portion 13 in turn extends from said annular portion 11 substantially about and along the cap axis 7.

Figure 3A:
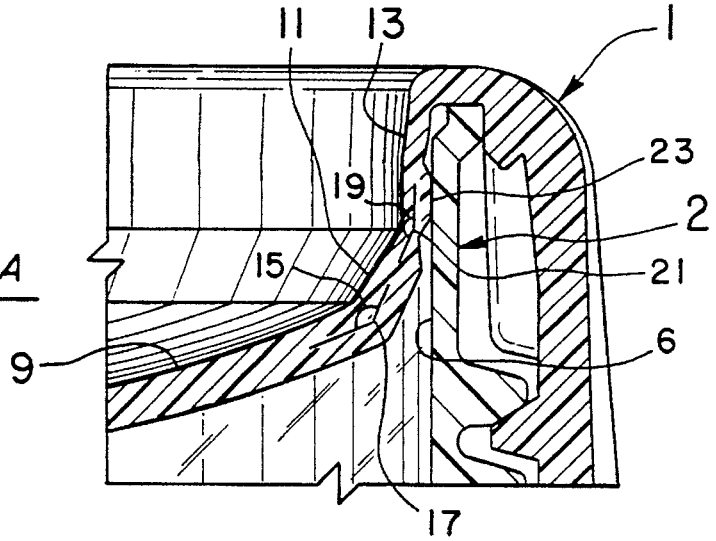
FIG. 3A is a further enlarged view of the right side of the assembled sealing cap and container of FIG. 3.

The dome-shaped portion 9 and annular portion 11 as best seen in the enlarged view of FIG. 3A are joined at an angle 15 (e.g., 145°) to each other at a first flexure area 17. The annular portion 11 and sealing portion 13 of the cap 1 are then joined preferably at a slightly larger angle 19 (e.g., 150°) to each other at a second flexure area 21. The sealing portion 13 as best seen in FIGS. 3 and 3A preferably includes a raised sealing part with an outwardly facing, cylindrical surface 23. This outwardly facing, cylindrical surface 23 is preferably spaced a distance farther from the cap axis 7 than the inwardly facing, cylindrical sealing surface 6 of the container mouth 4 is spaced from the container axis 10. In this manner as illustrated in FIG. 3, the diameter dimension $d_1$(e.g., 1.865 inches) of the cylindrical surface 23 is slightly greater (e.g., 0.015 inches) than the diameter $d_2$ (e.g., 1.850 inches) of the cylindrical sealing surface 6 of the container mouth 4.

Figure 4:
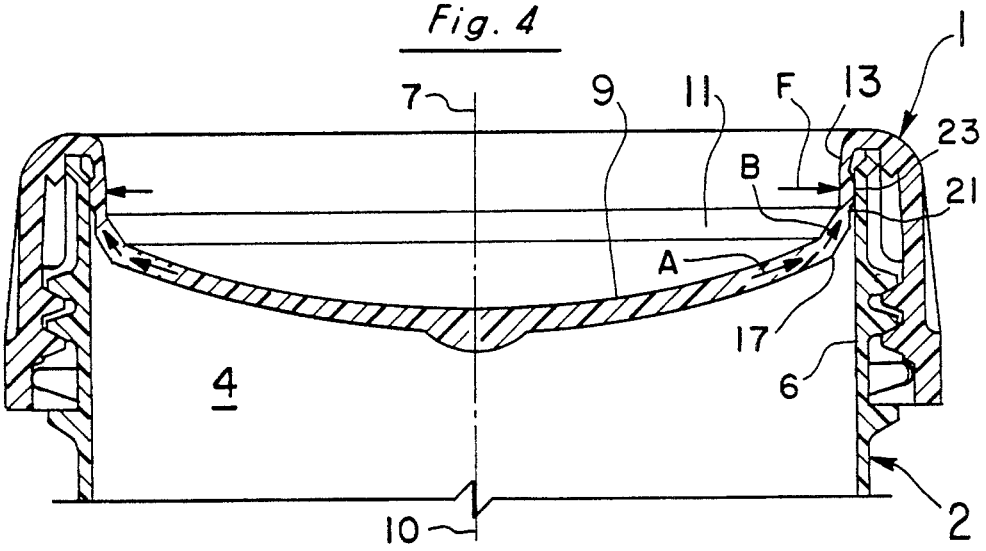
FIGS. 4–9 sequentially depict the controlled movement of the sealing cap in response to progressively increasing pressure within the container.
Figure 5:
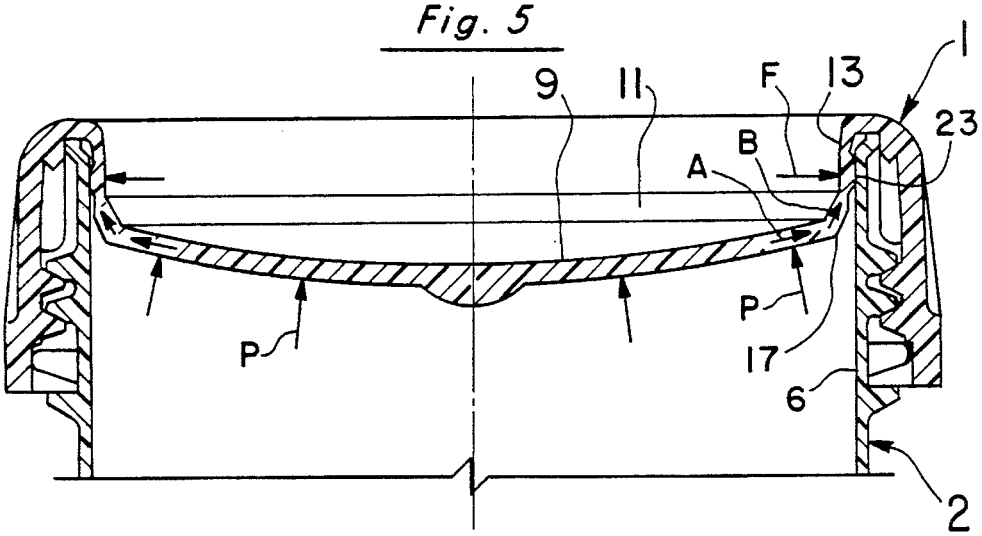
Figure 6:
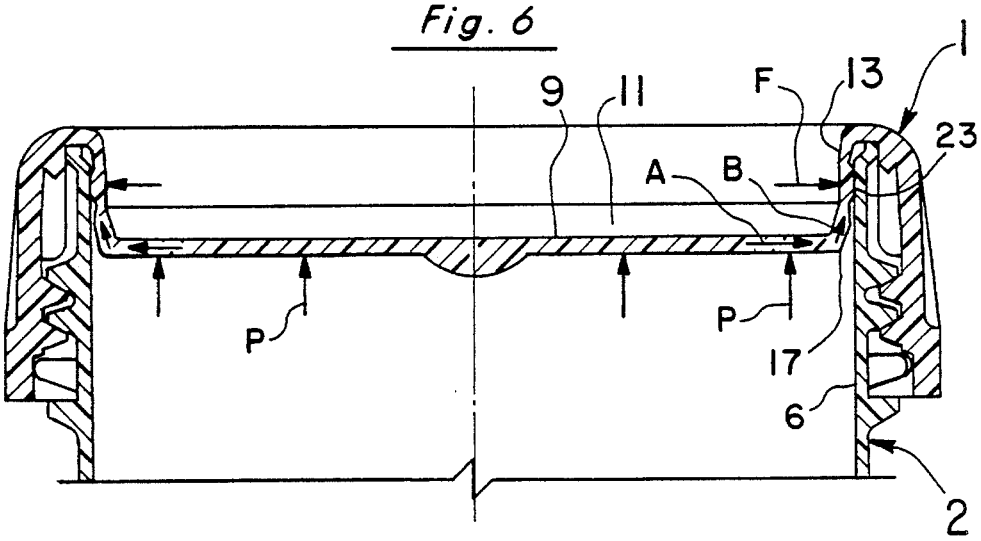

In operation as shown in FIGS. 4–9, the cap 1 is initially screwed onto the container 2 by engaging the mating thread portions 3 and 12 and twisting the cap 1 and container 2 relative to each other about the aligned axes 7 and 10. In doing so and because the diameter $d_1$ of the cylindrical surface 23 of the cap 1 is greater than the diameter $d_2$ of the sealing surface 6 of the container mouth 4, the cap 1 is tensioned or pre-loaded. This provides an initial, outwardly directed sealing force F serving to press the sealing surfaces 6 and 23 of the container 2 and cap 1 together to effect an initial seal (see FIG. 4). (This initial loading is also shown for clarity in the enlarged view of FIG. 10 wherein the cap 1 in its relaxed state is shown in dotted lines and in its pre-loaded or slightly distorted state is shown in solid lines.) The initial sealing force E in FIG. 4 is created regardless of whether there is a pressure differential across the cap 1. In this regard, the initial force F is essentially a result of the horizontal components of the forces generated in the cap portions 9, 11, and 13 as these cap portions are received in the container mouth 4 and assume the generally concave shape of FIG. 4. In this position, the cap surface 23 abuts and sealingly engages the container surface 6. Thereafter, as the relative pressure in the container 2 increases as indicated by arrows P in FIG. 5, the dome-shaped portion 9 first moves away from the initial concave shape of FIG. 4 to the flattened shape of FIG. 6 and then inverts to the convex shape of FIG. 7. In doing so, and as explained in more detail below, the central, dome-shaped portion 9 moves about the first flexure area 17. During this dome movement about flexure area 17, however, the annular portion 11 of the cap 1 preferably remains stationary relative to the seal portion 13 of the cap 1 and to the sealing surface 6 of the container mouth 4.

As the pressure P further increases (see FIG. 8), the annular portion 11 then moves substantially about the second flexure area 21 to a substantially flattened shape which is substantially perpendicular to the cap axis 7. During this movement and during all the movement of FIGS. 4–8, the sealing portion 13 including its sealing surface 23 is held in place by the threaded portions 3 and 12 and the cap skirt 5 to which the sealing portion 13 is attached. Consequently, during FIGS. 4–8, the sealing portion 13 including its sealing surface 23 preferably remains stationary relative to the sealing surface 6 of the container mouth 4. Additionally, in the positions of FIGS. 4–8, the dome-shaped portion 9 and annular portion 11 are both spaced from the inner sealing surface 6 of the container mouth 4 and preferably do not contact any other part of the container 2.

Figure 7:
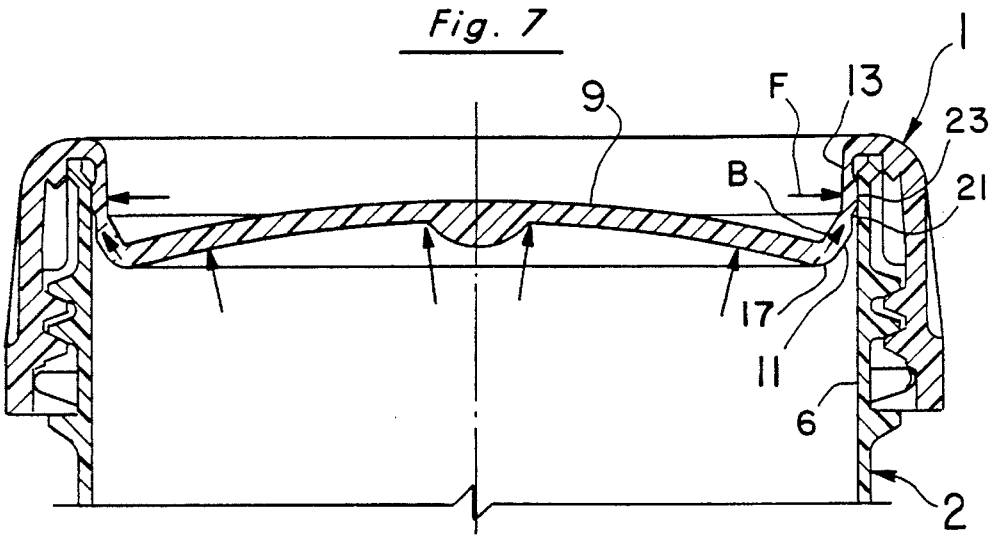
Figure 8:
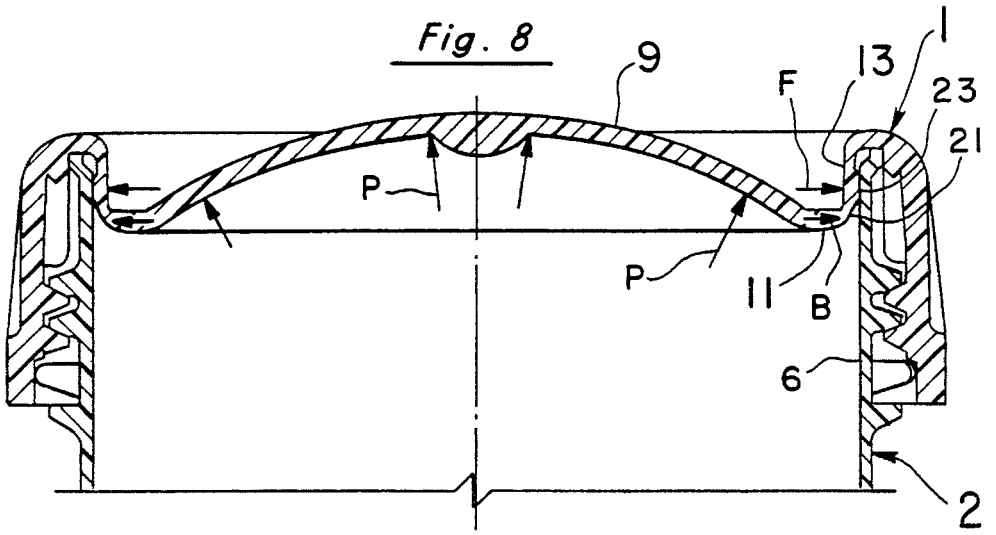
Figure 11:
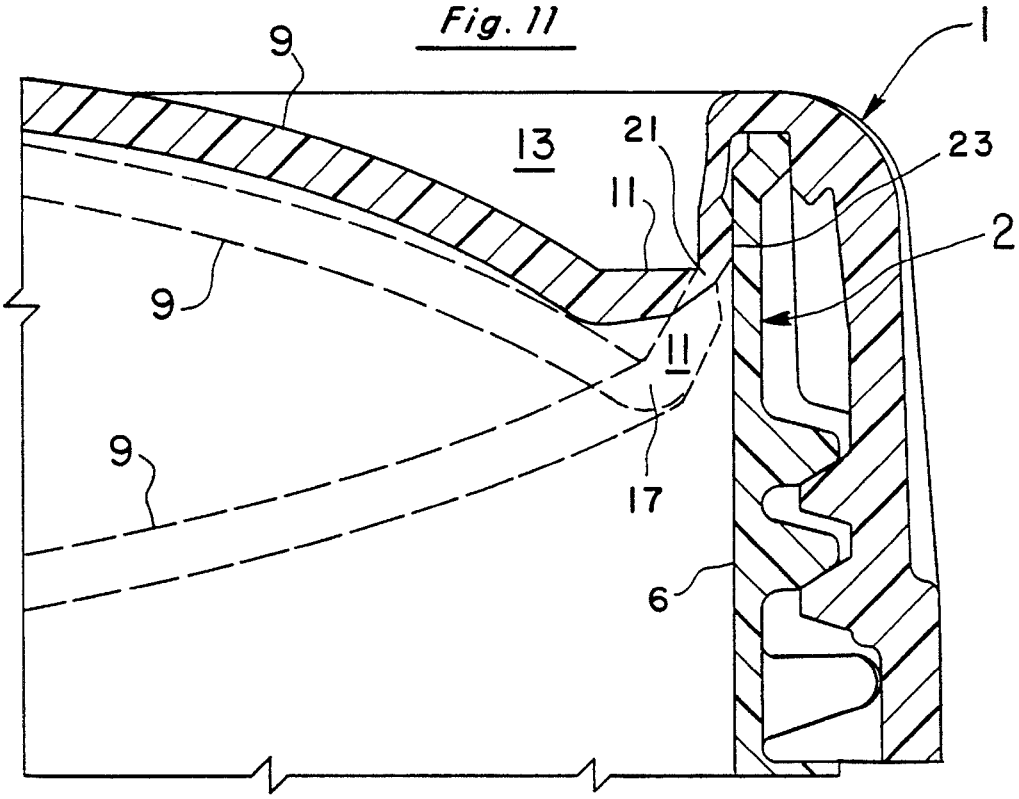
FIG. 11 is a sequential depiction of the controlled, relative movement of the cap portions in response to progressive pressure increases in the container. The illustrated positions correspond respectively to those shown in FIGS. 4, 7, and 8.

In the controlled, relative movement of the portions 9, 11, and 13 of the cap 1 in FIGS. 4–8, the sealing force F pressing the sealing surfaces 6 and 23 together progressively increases as the pressure P within the container 2 progressively increases. Consequently, the sealing force F is higher between each of the stages of FIGS. 4 through 8. This resulting force F is a direct consequence of the dome and annular shapes of the cap portions 9 and 11 and the controlled flexure areas 17 and 21. More specifically, the annular portion 11 (e.g., truncated cone) is inherently stronger than the dome-shaped portion 9 (e.g., spherical, elliptical). The annular portion 11 also has less surface area exposed to the pressure build up within the container 2 and a shorter moment arm for the applied pressure forces. Consequently, the dome-shaped portion 9 moves first about the flexure area 17 (between portions 9 and 11) in response to pressure increases within the container 2 (see FIGS. 4–7). Thereafter, as discussed above, further pressure build up within the container 2 will move the annular portion 11 about the second flexure area 21 (between portions 11 and 13) to the flattened position of FIG. 8. This controlled movement is also illustrated in the enlarged view of FIG. 11 in which the positions of the cap portions 9, 11, and 13 corresponding to FIGS. 4, 7, and 8 are illustrated.

This control of the relative movement of the cap portions 9, 11, and 13 resulting from the use of the dome and annular shapes 9 and 11 and flexure areas 17 and 21 progressively increases the applied sealing force F. In response, the sealing surface 23 of the sealing portion 13 of the cap 1 is progressively pressed tighter against the sealing surface 6 of the container mouth 4. This progressive increase as discussed above occurs between each stage from FIG. 4 to FIG. 8 as a direct response to pressure build up within the container 2 (e.g., due to fermentation of the urine sample or tissue). However, it is understood that the relative pressure increases in the container 2 depicted in FIGS. 4–8 could be equally caused by relative pressure reductions in the outer or surrounding ambient air. That is, the controlled movement of FIGS. 4–8 is caused by the build up of pressure differentials across the sealing cap 1. These obviously could be due to real pressure increases in the container 2 relative to the ambient air or real pressure decreases in the ambient air relative to the inside of the container 2 or combinations of both of these conditions. Also, the operation of the cap portions 9, 11, and 13 can be described in a broader sense by delineating the dome-shaped portion 9 and annular portion 11 as making up a central portion of the cap 1 about which the sealing portion 13 extends. As the pressure inside the container increases from FIGS. 4–8, the section 9 of the central portion 9 and 11 then moves away from the initial concave shape of FIG. 4 to the flattened position of FIG. 6 and subsequently to the inverted, convex shape of FIG. 7. During this sequence, the remainder 11 of the central portion 9 and 11 is maintained stationary relative to the sealing portion 13 and sealing surface 6 of the container mouth 4. The remainder 11 of the central portion 9 and 11 thereafter moves to the flattened shape of FIG. 8 in response to further pressure build up in the container 2.

Figure 9:
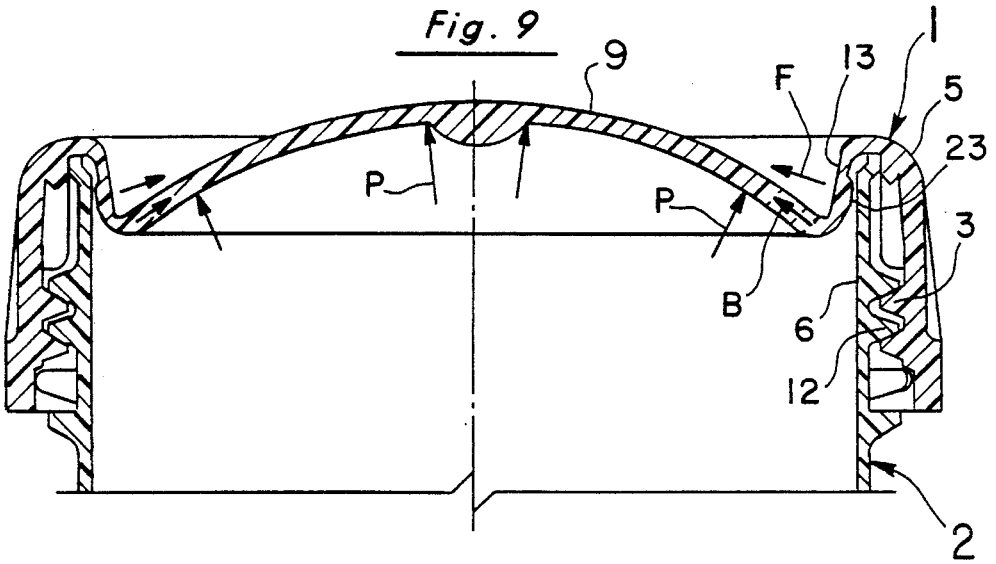
Figure 10:
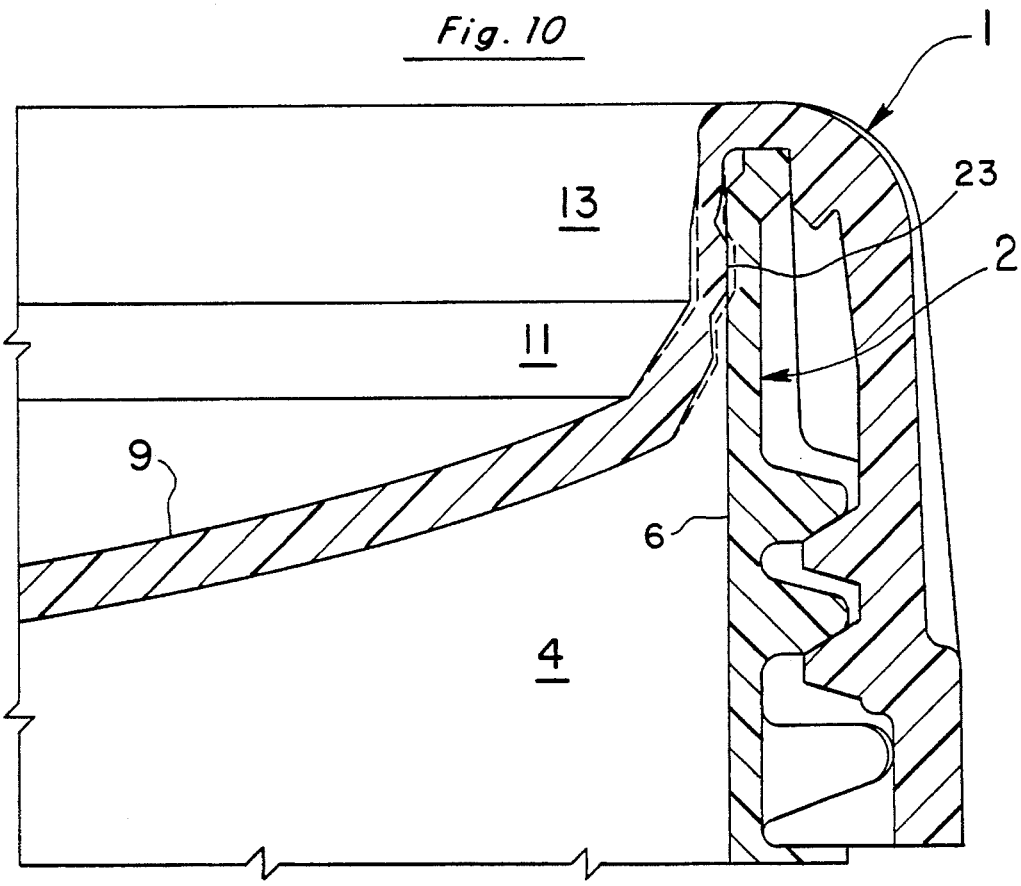
FIG. 10 is an enlarged view of the right side of the cap and container showing the manner in which the cap is dimensioned to create an initial sealing force against the inner sealing surface of the container mouth.

Regardless of the cause of the pressure build up inside the container 2 relative to the pressure outside the container 2, once the sealing cap 1 reaches the position of FIG. 8, any further pressure increase will serve to reduce the sealing force F. That is, any pressure increase beyond that of FIG. 8 will move the annular portion 11 beyond the flattened, perpendicular position of FIG. 8 toward the position of FIG. 9 (in which the annular portion 11 assumes a generally convex shape with the inverted, dome-shaped portion 9). In doing so as illustrated in FIG. 9 and as a safety feature, this movement serves to reduce the applied sealing force F by drawing the sealing surface 23 of the sealing portion 13 of the cap 1 away from sealing engagement with the sealing surface 6 of the container mouth 4. In this manner, any dangerously high pressure can be vented or relieved in a controlled manner passed the sealing surfaces 6 and 23 over the top of the container mouth 4 between the mouth top and cap skirt 5 (which are not intended to be a seal) and through the threaded portions 3 and 12 (which also are not intended to be a seal, at least not at the pressures of FIG. 9). As stated above, this drawing away from FIG. 8 to FIG. 9 essentially acts as a safety feature as the cap 1 and container 2 arrangement might otherwise fracture or even possibly explode leaking all of the container's contents.

Figure 12:
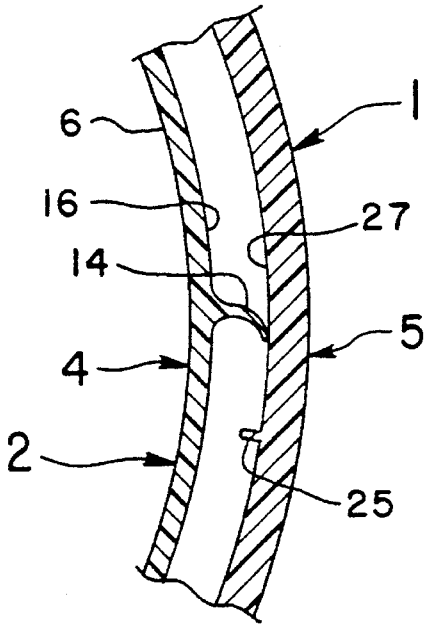
FIG. 12 is a view along line 12—12 of FIG. 2 showing the reed and protuberance arrangement between the cap and container that serves to produce an audible signal or click as the cap is twisted onto the container to the initial sealing position of FIG. 4.
Figure 13:
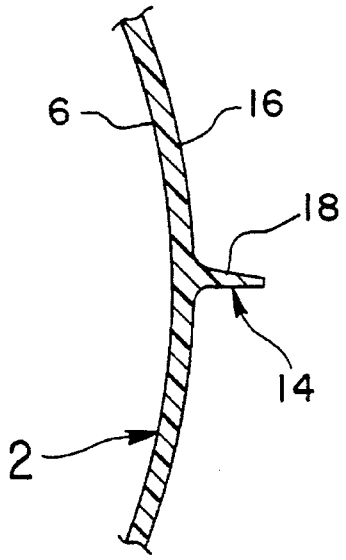
FIG. 13 illustrates the reed of FIG. 12 in a relaxed state.

The cap 1 and container 2 combination of the present invention also includes an audible signal arrangement (see FIGS. 12–15) to signal the user when the cap 1 has been sufficiently twisted or threaded onto the container 2 to initially effect the seal of FIG. 4. In this regard, FIG. 12 is a view taken along line 12—12 of FIG. 2 showing the flexible reed 14 and relatively rigid protuberance 25 that cooperate to produce the desired signal or click. More specifically, as shown in FIG. 13, the reed 14 preferably extends outwardly of the container 2 for a distance greater than the spacing between the cylindrical surfaces 16 and 27 of the container 2 and cap 1. Consequently, in the relaxed state of FIG. 13, the flexible reed 14 extends nearly radially outwardly of the container 2 preferably with a slight incline or taper (e.g., 10°) on the face 18.

Figure 14:
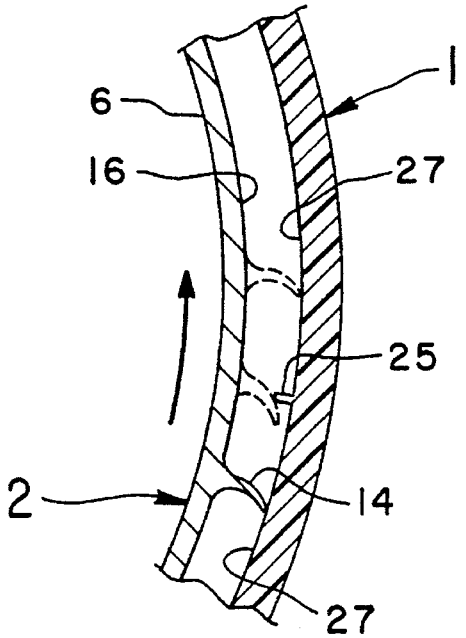
FIG. 14 sequentially illustrates the relative movement of the reed and protuberance that produces the audible, click signal.
Figure 15:
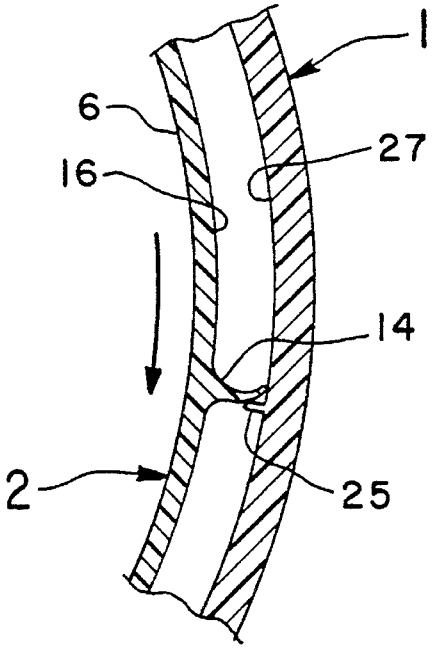
FIG. 15 illustrates the positions of the reed and protuberance when the relative twisting movement of the cap and container is reversed tending to unscrew the cap from the container.

In operation as sequentially shown in FIG. 14, the container 2 and cap 1 are twisted relative to each other (e.g., by rotating the container 2 relative to the cap 1 as shown in FIG. 14 or vice versa or simultaneously rotating the container 2 and cap 1 in opposite directions). As the flexible reed 14 is moved along and in contact with the opposing surface 27 of the cap 1, the reed 14 flexes away from the direction of relative movement and eventually contacts and rides up onto the rigid protuberance 25 on the cap 1. This action cocks the resilient reed 14. Continued movement of the reed 14 passed the protuberance 25 then results in the flexible, resilient reed 14 snapping back and creating an audible signal or click. In snapping back, the reed 14 also strikes the surface 27 of the cap 1. This audible click indicates to the user that the engaged threaded portions 3 and 12 of the cap 1 and container 2 have been sufficiently rotated to advance the cap 1 onto the container 2 to the initial sealing position of FIG. 4. The click is thus a positive indication to the user that the desired, predetermined level of engagement between the cap 1 and container 2 has been reached to effect the initial seal of FIG. 4. Conversely, reverse twisting or unscrewing of the cap 1 and container 2 as depicted in FIG. 15 will eventually result in the reed 14 again contacting the protuberance 25. With continued unscrewing (and in a reverse fashion from FIG. 14), a second audible signal or click will be created telling the user that the cap 1 and container 2 have been opened beyond the initial sealing position of FIG. 4.

The cap 1 and container 2 are preferably made of materials of different hardnesses (i.e., durometer readings). This is primarily done to enhance the sealing characteristics of the cap 1 and container 2 as the softer material will tend to conform to the harder one and create a better seal. For a number of reasons including tactile feel to the user, the cap 1 is preferably made of the softer material (e.g., high density polyethylene) versus the container 2 (e.g., polypropylene). The resilient, flexible reed 14 is then preferably molded as a part of the container 2 so that as the reed 14 recoils and strikes the cap 1, the reed 14 will cause the larger and harder container 2 to resonant. This creates a louder signal or click than if the reed 14 and protuberance 25 were reversed. As a practical matter and in actual use, both the cap 1 and container 2 will resonant adding to the volume or loudness (and feel) of the click signal but the larger part of the signal is created by the resonance or vibration of the larger and harder container 2. In the preferred embodiment, there are actually two reed 14 and protuberance 25 arrangements spaced from one another 180°. In this manner, one reed-protuberance arrangement can act as a back up to the other for safety considerations. Also, the threads of portions 3 and 12 can then be partial or broken spirals that can be engaged at two locations 180° apart for the added convenience of the user. In threading the cap 1 onto the container 2, the respective cap and container axes 7 and 10 are aligned. Consequently, they form a common axis about which the surfaces 16 and 27 extend with the reed 14 and protuberance 25 extending substantially radially of this common axis.

While several embodiments of the present invention have been shown and described in detail, it is to be understood that various changes and modifications could be made without departing from the scope of the invention. For example, the cap and container of the present invention were primarily designed for medical use but could have other applications. The dimensions and thicknesses illustrated (e.g., the cap portions 9, 11, and 13 at sealing surface 23 of the preferred embodiment have thickness of about 0.050, 0.055, and 0.033 inches respectively) are also shown with medical use in mind. However, they could be varied as long as the controlled, sequential movement of FIGS. 4–8 is maintained. The annular portion 11 is also preferably a truncated cone with slight tapers (e.g., 5°) on its outside wall down to the sealing portion 13 but the annular portion 11 could be other shapes as long as the controlled, sequential movement of FIGS. 4–8 is maintained. The preferred embodiment is also shown and described with threaded portions 3 and 12 as the engagement advancing mechanism but this could also be a simple snap or other fit.

I claim:

1. An invertible, pressure-responsive sealing cap and container combination including:

a container with an open mouth having an inner sealing surface extending substantially about and along an axis and an invertible, pressure-responsive sealing cap having a central portion invertible from an initial concave dome shape to a convex dome shade and extending outwardly from and about an axis, an annular portion extending outwardly of and about said initially concave, dome-shaped portion, and a sealing portion extending from said annular portion substantially about and along the axis of said cap, said initially concave, dome-shaped portion and said annular portion being joined at an angle to each other at a first flexure area and said annular portion and said sealing portion being joined at an angle to each other at a second flexure area, said initially concave, dome-shaped portion, annular portion, and sealing portion together assuming an overall concave shape and being receivable in the mouth of said container with at least a part of said sealing portion abutting and initially sealing against the sealing surface of the container mouth substantially about the axis of said container and with said annular portion and said initially concave, dome-shaped portion spaced from the sealing surface of said container mouth, said cap being responsive to pressure build up inside the container relative to pressure outside the container and including means for progressively pressing said part of the sealing portion of said cap tighter against the sealing surface of said container mouth as the pressure inside the container increases relative to the pressure outside the container, said means for progressively pressing said part of said sealing portion tighter against said sealing surface including said initially concave, dome-shaped portion and said annular portion and further including means for controlling the relative movement of said initially concave, dome-shaped portion and said annular portion as said pressure increases inside said container to first allow said initially concave, dome-shaped portion to move substantially about said first flexure area away from said initially concave, dome shape to a substantially flattened shape substantially perpendicular to the axis of said cap and then invert to a convex dome shape while maintaining said annular portion substantially stationary relative to said sealing portion and to the sealing surface of said container mouth, said movement controlling means thereafter allowing said annular portion to move substantially about said second flexure area to a position substantially perpendicular to the axis of said cap.

2. The combination of claim 1 wherein said annular portion assumes a substantially flattened shape in said position substantially perpendicular to the axis of said cap.

3. The combination of claim 1 wherein said annular portion is a truncated cone.

4. The combination of claim 1 wherein said inner sealing surface of said container mouth is a substantially smooth surface.

5. The combination of claim 4 wherein said inner sealing surface of said container mouth is substantially cylindrical about the axis of said container.

6. The combination of claim 5 wherein said part of said sealing portion of said cap includes a substantially smooth, cylindrical surface substantially facing outwardly of the axis of said cap and abutting and sealing against the substantially smooth, inwardly facing cylindrical surface of said container mouth.

7. The combination of claim 6 wherein the cylindrical surface of said cap extends about the axis of said cap at a first distance in a relaxed state when the cap is removed from the container and said cylindrical sealing surface of said container mouth extends about the axis of said container at a second distance less than the first distance wherein said cap is distorted from said relaxed state when received in the mouth of the container in said concave shape and said cap applies an initial force pressing said cylindrical surface of said part of said sealing portion of the cap against the cylindrical, sealing surface of said container mouth.

8. The combination of claim 1 wherein said movement controlling means allows said annular portion of said cap to move to said position substantially perpendicular to the axis of said cap while maintaining said sealing portion substantially stationary relative to said sealing surface of the container mouth.

9. The combination of claim 8 further including means for drawing said sealing portion of said cap away from sealing engagement with the sealing surface of said container mouth as the pressure inside said container further increases to move said annular portion of said cap beyond said position substantially perpendicular to the axis of said cap into a convex shape with said inverted, convex, dome-shaped portion of said cap.

10. The combination of claim 1 further including means for drawing said sealing portion of said cap away from sealing engagement with the sealing surface of said container mouth as the pressure inside said container further increases to move said annular portion of said cap beyond said position substantially perpendicular to the axis of said cap into a convex shape with said inverted, convex, dome-shaped portion of said cap.

11. The combination of claim 1 wherein said container mouth has a threaded portion facing outwardly of the container axis and said cap has a skirt with a threaded portion facing inwardly toward the cap axis, said threaded portions engaging and mating with one another and being rotatable relative to each other to advance said initially concave, dome-shaped portion, annular portion, and sealing portion of said cap into the mouth of said container to assume said overall concave shape with said part of said sealing portion of said cap abutting and sealing against the sealing surface of said container mouth.

12. The combination of claim 11 wherein one of said threaded portions has a resilient, flexible reed attached thereto and the other of said threaded portions has a relatively rigid protuberance attached thereto, said reed and protuberance striking each other to produce an audible click as said threaded portions are rotated relative to each other to a position where said cap is received in said container mouth and assumes said overall concave shape with said part of said sealing portion abutting and sealing against the sealing surface of the container mouth.

13. The combination of claim 11 wherein said container mouth and cap skirt have respective surfaces facing each other and spaced a first distance apart when said threaded portions are engaged, one of said container mouth and cap skirt having a resilient, flexible reed extending from the surface thereof in a relaxed state for a distance greater than said first distance wherein said reed extends toward and engages the surface of the other of said container mouth and cap skirt and is flexed away from said relaxed state when said threaded portions are engaged, and said other of said container mouth and cap skirt has a relatively rigid protuberance extending from the surface thereof toward the surface of said one of said container mouth and cap skirt when said threaded portions are engaged wherein said flexible reed member contacts and rides onto the rigid protuberance as the threaded portions are rotated relative to each other and thereafter passes over the protuberance and resiliently recoils to strike the surface of the other of said container mouth and cap skirt as the threaded portions are further rotated relative to each other.

14. The combination of claim 13 wherein said reed is on said container mouth and said protuberance is on said cap skirt.

15. The combination of claim 14 wherein said container mouth is made of harder material than said cap skirt.

16. The combination of claim 13 wherein said surfaces are substantially cylindrical about a common axis when said threaded portions are engaged.

17. The combination of claim 16 wherein said reed and said protuberance extend substantially radially of said common axis when said threaded portions are engaged.

18. The combination of claim 13 wherein said cap axis and container axis form a common axis when said threaded portions are engaged and wherein a second reed and protuberance corresponding to the first reed and protuberance are positioned on said container mouth and cap skirt with said second reed spaced 180 degrees about said common axis from said first reed and said second protuberance spaced 180 degrees about said common axis from said first protuberance.

19. An invertible, pressure-responsive sealing cap and container combination including:

a container with an open mouth with an inner sealing surface extending substantially about and along an axis, said sealing surface substantially facing inwardly toward said axis and an invertible, pressure-responsive sealing cap having a central portion with a central section extending outwardly from and about an axis and assuming an initial concave shape, said cap further including a sealing portion extending from said central portion substantially about and along the axis of said cap, said central portion and said sealing portion together assuming an overall concave shape and being receivable in the mouth of said container with at least a part of said sealing portion of said cap abutting and initially sealing against the sealing surface of the container mouth substantially about the axis of said container and with the central portion of said cap spaced from the sealing surface of said container mouth, said cap being responsive to pressure build up inside the container relative to pressure outside the container and including means for progressively pressing said part of said sealing portion of said cap tighter against the sealing surface of the container mouth as the pressure inside the container increases relative to the pressure outside the container, said means for progressively pressing said part of said sealing portion of said cap tighter against said sealing surface of said container mouth including said central portion and means for controlling movement of said central portion as said pressure increases inside said container relative to the pressure outside the container to first allow said initially concave, section of said central portion to move away from said initially concave shape to a substantially flattened shape substantially perpendicular to the axis of said cap and then invert to a convex shape while maintaining the remainder of said central portion substantially stationary relative to said sealing portion and to the sealing surface of the container mouth, said movement controlling means thereafter allowing the remainder of said central portion to move to a position substantially perpendicular to the axis of said cap.

20. The combination of claim 19 wherein said inner sealing surface of said container mouth is a substantially smooth surface.

21. The combination of claim 20 wherein said inner sealing surface of said container mouth is substantially cylindrical about the axis of said container.

22. The combination of claim 21 wherein said part of said sealing portion of said cap includes a substantially smooth, cylindrical surface substantially facing outwardly of the axis of said cap and abutting and sealing against the substantially smooth, inwardly facing, cylindrical surface of said container mouth.

23. The combination of claim 22 wherein the cylindrical surface of said cap extends about the axis of said cap at a first distance in a relaxed state when the cap is removed from the container and said cylindrical sealing surface of said container mouth extends about the axis of said container at a second distance less than the first distance wherein said cap is distorted from said relaxed state when received in the mouth of the container in said overall concave shape and said cap applies an initial force pressing said cylindrical surface of said part of said sealing portion of the cap against the cylindrical, sealing surface of said container mouth.

24. The combination of claim 19 wherein said remainder of said central portion of said cap is a truncated cone.

25. The combination of claim 19 wherein said section of said central portion is dome shaped when said section assumes said convex shape.

26. The combination of claim 19 wherein said movement controlling means includes means for allowing said remainder of said central portion to move to said position substantially perpendicular to the axis of said cap while maintaining said sealing portion substantially stationary relative to said sealing surface of the container mouth.

27. The combination of claim 26 further including means for drawing said sealing portion of said cap away from sealing engagement with the sealing surface of said container mouth as the pressure inside said container further increases to move said remainder of said central portion beyond said position substantially perpendicular to the axis of said cap into a convex shape with said inverted section of said central portion.

28. The combination of claim 19 further including means for drawing said sealing portion of said cap away from sealing engagement with the sealing surface of said container mouth as the pressure inside said container further increases to move said remainder of said central portion beyond said position substantially perpendicular to the axis of said cap into a convex shape with said inverted section of said central portion.

29. The combination of claim 19 wherein said container mouth has a threaded portion facing outwardly of the container axis and said cap has a skirt with a threaded portion facing inwardly toward the cap axis, said threaded portions engaging and mating with one another and being rotatable relative to each other to advance said central portion and said sealing portion of said cap into the mouth of said container to assume said overall concave shape with said part of said sealing portion of said cap abutting and sealing against the sealing surface of said container mouth.

30. The combination of claim 29 wherein one of said threaded portions has a resilient, flexible reed attached thereto and the other of said threaded portions has a relatively rigid protuberance attached thereto, said reed and protuberance striking each other to produce an audible click as said threaded portions are rotated relative to each other to a position where said cap is received in said container mouth and assumes said overall concave shape with said part of said sealing portion abutting and sealing against the sealing surface of the container mouth.

31. The combination of claim 29 wherein said container mouth and cap skirt have respective surfaces facing each other and spaced a first distance apart when said threaded portions are engaged, one of said container mouth and cap skirt having a resilient, flexible reed extending from the surface thereof in a relaxed state for a distance greater than said first distance wherein said reed extends toward and engages the surface of the other of said container mouth and cap skirt and is flexed away from said relaxed state when said threaded portions are engaged, and said other of said container mouth and cap skirt has a relatively rigid protuberance extending from the surface thereof toward the surface of said one of said container mouth and cap skirt when said threaded portions are engaged wherein said flexible reed member contacts and rides onto the rigid protuberance as the threaded portions are rotated relative to each other and thereafter passes over the protuberance and resiliently recoils to strike the surface of the other of said container mouth and cap skirt as the threaded portions are further rotated relative to each other.

32. The combination of claim 31 wherein said reed is on said container mouth and said protuberance is on said cap skirt.

33. The combination of claim 32 wherein said container mouth is made of harder material than said cap skirt.

34. The combination of claim 29 wherein said surfaces are substantially cylindrical about a common axis when said threaded portions are engaged.

35. The combination of claim 34 wherein said reed and said protuberance extend substantially radially of said common axis when said threaded portions are engaged.

36. The combination of claim 29 wherein said cap axis and container axis form a common axis when said threaded portions are engaged and wherein a second reed and protuberance corresponding to the first reed and protuberance are positioned on said container mouth and cap skirt with said second reed spaced 180 degrees about said common axis from said first reed and said second protuberance spaced 180 degrees about said common axis from said first protuberance.

37. An audible signal arrangement primarily intended for use with two threaded members to signal a user when a predetermined level of engagement has been achieved between the two members, said audible signal arrangement including:

first and second members, each member having a threaded portion with said threaded portions engaging and mating with each other and being rotatable relative to each other to move said members relative to each other along an axis, said members respectively having surfaces spaced a first distance from each other when said threaded portions are engaged, said first member having a resilient, flexible reed extending from the surface of said first member in a relaxed state for a distance greater than said first distance wherein said reed extends toward and engages the surface of said second member and is flexed away from said relaxed state when said threaded portions are engaged, and said second member having a relatively rigid protuberance extending from the surface of said second member toward the surface of said first member when said threaded portions are engaged wherein said resilient, flexible reed contacts and rides onto the rigid protuberance as the two members are rotated toward the level of predetermined engagement and thereafter passes over said rigid protuberance and resiliently recoils to strike the surface of said second member as the two members are further rotated to said level of predetermined engagement.

38. The audible signal arrangement of claim 37 wherein one of said first and second members is a sealing cap and the other of said first and second members is a container.

39. The audible signal arrangement of claim 38 wherein said sealing cap sealingly engages said container at said predetermined level of engagement.

40. The audible signal arrangement of claim 37 wherein said first and second members are made of materials of different hardnesses.

41. The audible signal arrangement of claim 40 wherein said first member is made of harder material than said second member.

42. The audible signal arrangement of claim 37 wherein said surfaces are substantially cylindrical about said axis when said threaded portions are engaged.

43. The audible signal arrangement of claim 42 wherein said reed and said protuberance extend substantially radially of said axis when said threaded portions are engaged.

44. The audible signal arrangement of claim 37 wherein a second reed and protuberance corresponding to the first reed and protuberance are positioned on said first and second members with said second reed spaced 180 degrees about said axis from said first reed and said second protuberance spaced 180 degrees about said axis from said first protuberance.

* * * * *